US006755552B2

(12) United States Patent
Lee

(10) Patent No.: US 6,755,552 B2
(45) Date of Patent: Jun. 29, 2004

(54) CONDUCTIVE PLATE OF A BULB ASSEMBLY

(76) Inventor: Hung-Wen Lee, No. 188. Shien Cheng 2nd Road, Chupei, Hsinchu Shien (TW)

( * ) Notice: Subject to any disclaimer, the term of this patent is extended or adjusted under 35 U.S.C. 154(b) by 32 days.

(21) Appl. No.: 10/127,712

(22) Filed: Apr. 23, 2002

(65) Prior Publication Data

US 2003/0198044 A1 Oct. 23, 2003

(51) Int. Cl.[7] ..... H01R 33/00

(52) U.S. Cl. ..... 362/226; 439/699.2

(58) Field of Search ..... 362/226, 252, 362/806, 257, 249; 439/699.1, 699.2, 825

(56) References Cited

U.S. PATENT DOCUMENTS

| | | | | |
|---|---|---|---|---|
| 4,411,486 A | * | 10/1983 | Behrendt | 439/622 |
| 6,257,740 B1 | * | 7/2001 | Gibboney, Jr. | 362/288 |
| 6,299,492 B1 | * | 10/2001 | Pierini et al. | 439/884 |
| 6,340,310 B2 | * | 1/2002 | Henrici et al. | 439/346 |

* cited by examiner

*Primary Examiner*—Alan Cariaso
*Assistant Examiner*—Ali Alavi
(74) *Attorney, Agent, or Firm*—Rosenberg, Klein & Lee

(57) ABSTRACT

The present invention relates to a conductive plate of a bulb assembly, which includes a connector, a holder, and a bulb. Conductive plate, which is received in the connector is formed an inward elastic slice inclinedly from middle portion of the conductive plate. While the holder with the bulb is received in the connector, the elastic slice is effectively contact with conductive wire of the bulb for perfect electrical connection.

1 Claim, 3 Drawing Sheets

CONDUCTIVE PLATE OF A BULB ASSEMBLY

BACKGROUND OF THE INVENTION

Referring to FIGS. 1 to 3, a conventional bulb assembly of a lighting string includes a connector (1), a holder (2), and a bulb (3). Conductive plates (4) are provided in the connector (1), such that the plates (4) can contact with conductive wires (31) of the bulb (3), when the bulb (3) and the holder (2) are assembled within the connector (1). This known conductive plate (4), in order to provide effective elastic contact, is designed with an elastic plate (41), which is folded upside-down from the conductive plate (4) and is inclined. As assembly, the folded portion (42) between the conductive plate (4) and the elastic plate (41) will be easily broken under elastic compress. When the elastic plate (41) is fallen, it causes ineffective electrical contact between the conductive plate (4) and the conductive wire (31) of the bulb (3).

Accordingly, the primary object of the invention is to provide a conductive plate of a bulb assembly, which uses a part of the plate to be folded inward. The improved conductive plate with inward slice obtains a strong strength for preventing from drawbacks of a prior one. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
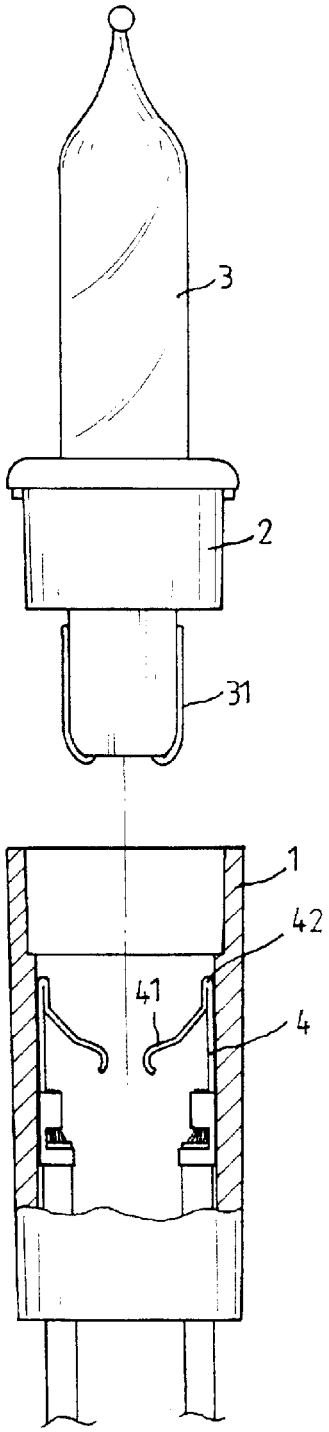
FIG. 1 (prior art)
FIG. 1 is a cross-sectional plan view showing an exploded bulb assembly of a prior structure.
Figure 2:
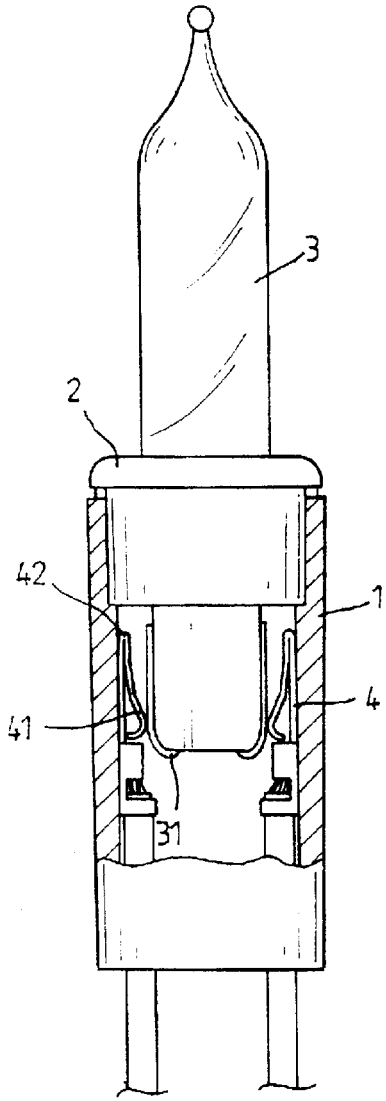
FIG. 2 (prior art)
FIG. 2 is an assembled view of FIG. 1.
Figure 3:
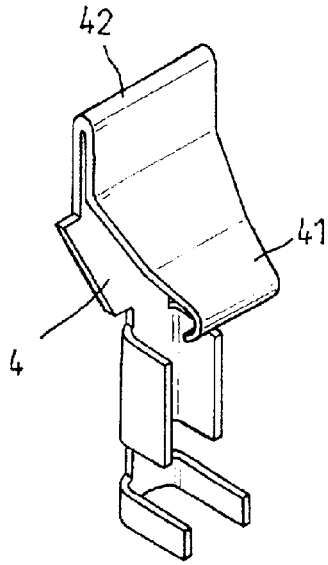
FIG. 3 (prior art)
FIG. 3 is a perspective view showing a conductive plate of FIG. 1.
Figure 4:
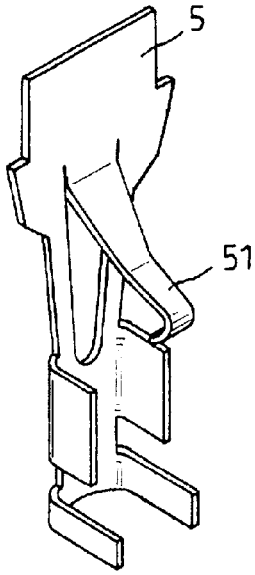
FIG. 4 is a perspective view showing a conductive plate according to the present invention.
Figure 5:
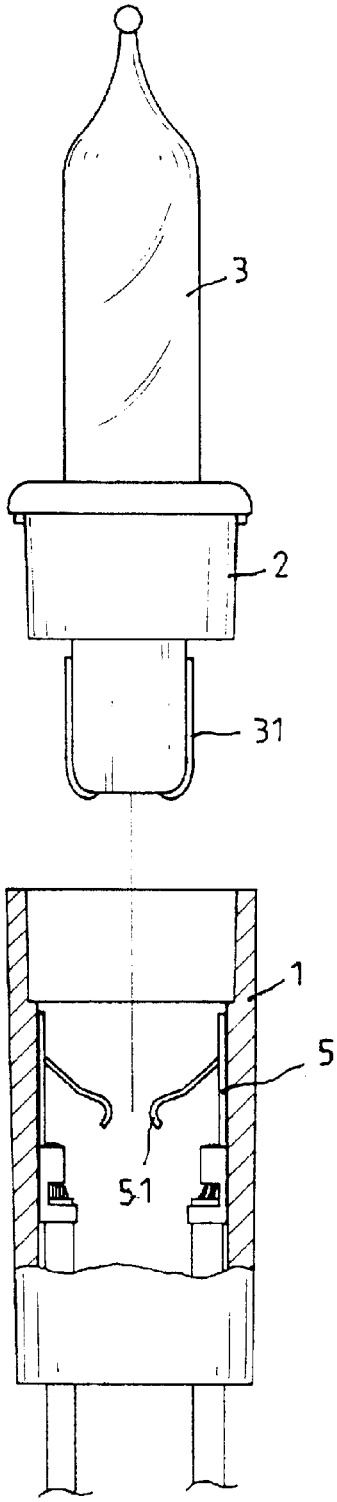
FIG. 5 is a cross-sectional plan view showing an exploded bulb assembly according to the present invention.
Figure 6:
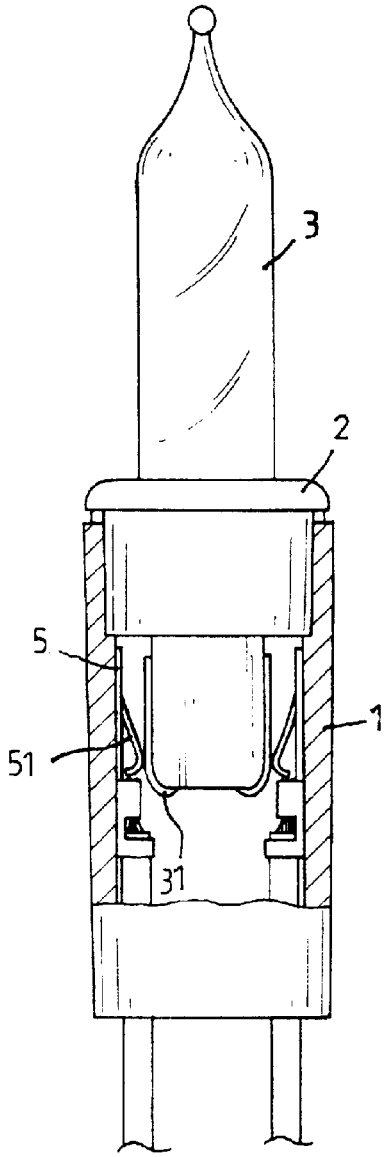
FIG. 6 is an assembled view of FIG. 5.

Please refer to FIGS. 4 to 6, the present invention mainly relates to an improvement of a conductive plate (5) provided in a connector (1) of a bulb assembly. The conductive plate (5) is formed with an inner elastic slice (51) from middle portion, which can be folded inward to be inclined directly, as shown in FIG. 4. Thus, when a holder (2) with a bulb (3) is received in the connector (3), the elastic slice (51) can effectively and elastically contact with conductive wire (31) of the bulb (3) respectively for obtaining electrical connection.

Under the improved structure of this invention, the elastic slice (51) is just bent inclinedly inward without a folded portion. And when assembly, the elastic slice (51) is forced outward that will not be any possibility in broken of the conductive plate and overcomes the drawback of a known design.

Accordingly, the invented assembly of the present invention obviously obtains utility and improvement. It should be allowed for patent and is applied.

What is claimed is:

1. A removable light bulb system comprising:

a hollow bulb connector defining a chamber therein;

a conductive plate being received within said chamber, said conductive plate having an opening formed therethrough and a conductive elastic spring element projecting from an upper edge of said opening, said opening having a contour conforming to a contour of said conductive elastic spring element; and, a light bulb received by said hollow bulb connector, said light bulb having an electrically conductive portion, said electrically conductive portion being removably received within said chamber, said conductive elastic spring element of said conductive plate being adapted to be in freely releasable electrical contact with said electrically conductive portion of said light bulb.

* * * * *

US006755552C1

(12) EX PARTE REEXAMINATION CERTIFICATE (7174th)

United States Patent
Lee

(10) Number: US 6,755,552 C1
(45) Certificate Issued: Nov. 17, 2009

(54) CONDUCTIVE PLATE OF A BULB ASSEMBLY

(76) Inventor: Hung-Wen Lee, No. 188. Shien Cheng 2nd Road, Chupei, Hsinchu Shien (TW)

Reexamination Request:
No. 90/010,142, Apr. 17, 2008

Reexamination Certificate for:

| | |
|---|---|
| Patent No.: | **6,755,552** |
| Issued: | **Jun. 29, 2004** |
| Appl. No.: | **10/127,712** |
| Filed: | **Apr. 23, 2002** |

(51) Int. Cl.
*H01R 33/09* (2006.01)
*H01R 33/05* (2006.01)

(52) U.S. Cl. ..... 362/647; 362/226; 362/252; 362/806; 362/257; 362/249; 439/699.1; 439/699.2; 439/825

(58) Field of Classification Search ..... None
See application file for complete search history.

(56) References Cited

U.S. PATENT DOCUMENTS

| | | | |
|---|---|---|---|
| 6,022,241 | A | 2/2000 | Lin |
| 6,340,310 | B2 | 1/2002 | Henrici et al. |

FOREIGN PATENT DOCUMENTS

| | | | |
|---|---|---|---|
| CN | 2266069 | Y | 10/1997 |
| DE | 20106154 | UI | 8/2001 |

*Primary Examiner*—Linh M. Nguyen

(57) ABSTRACT

The present invention relates to a conductive plate of a bulb assembly, which includes a connector, a holder, and a bulb. Conductive plate, which is received in the connector is formed an inward elastic slice inclinedly from middle portion of the conductive plate. While the holder with the bulb is received in the connector, the elastic slice is effectively contact with conductive wire of the bulb for perfect electrical connection.

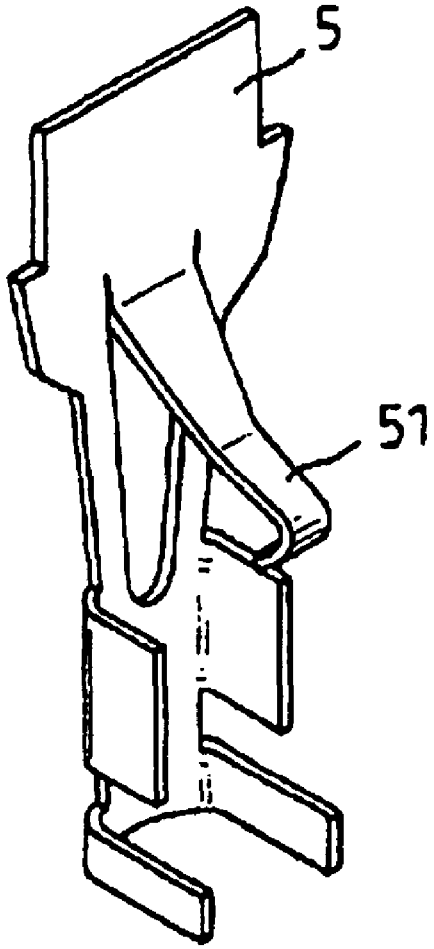

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

1. A removable light bulb system comprising:

a hollow bulb connector defining a chamber therein;

a conductive plate being received within said chamber, said conductive plate having an opening formed therethrough and a conductive elastic spring element [projecting] *extending outward* from an upper edge of said opening *and being joined with a planar section of said conductive plate*, said opening having a contour conforming to a contour of said conductive elastic spring element; and, a light bulb received by said hollow bulb connector, said light bulb having an electrically conductive portion, said electrically conductive portion *having conductive wires and* being removably received within said chamber, said conductive elastic spring element of said conductive plate *having an arcuate end section for electrically contacting said conductive wires of said electrically conductive portion of said light bulb and* being adapted to be in freely releasable electrical contact with said electrically conductive [portion] *wires* of said light bulb.

* * * * *